US007384208B2

(12) United States Patent
Bouix et al.

(10) Patent No.: US 7,384,208 B2
(45) Date of Patent: Jun. 10, 2008

(54) FLOW-THRU COSMETIC APPLICATOR PACKAGE

(75) Inventors: Herve F. Bouix, New York, NY (US); Jonathan T. Thayer, Nutley, NJ (US)

(73) Assignee: EL Management Corp., New York, NY (US)

( * ) Notice: Subject to any disclaimer, the term of this patent is extended or adjusted under 35 U.S.C. 154(b) by 457 days.

(21) Appl. No.: 11/091,046

(22) Filed: Mar. 28, 2005

(65) Prior Publication Data

US 2006/0216104 A1 Sep. 28, 2006

(51) Int. Cl.
*A46B 17/04* (2006.01)
*B43K 5/00* (2006.01)

(52) U.S. Cl. ..... 401/269; 401/202; 401/205

(58) Field of Classification Search ..... 401/202, 401/205, 206, 121, 122, 262, 263, 265, 269, 401/273, 278; 222/502, 503, 544, 547, 556, 222/557

See application file for complete search history.

(56) References Cited

U.S. PATENT DOCUMENTS 1,067,596 A 7/1913 Fesler
2,101,310 A * 12/1937 Callaghan ..... 401/167
2,187,671 A * 1/1940 Suddarth ..... 401/205
2,901,152 A * 8/1959 Wahnsiedler ..... 222/502
2,994,897 A 8/1961 Snable
3,545,874 A 12/1970 Schwartzman
3,655,290 A 4/1972 Griffith
4,040,753 A 8/1977 Griffith
4,368,746 A 1/1983 Spatz
4,609,300 A * 9/1986 Robert ..... 401/122
4,739,906 A * 4/1988 LoTurco ..... 222/212
4,748,990 A 6/1988 Brown
5,397,195 A 3/1995 Goncalves
5,667,084 A * 9/1997 Duggal et al. ..... 215/11.4
5,904,433 A 5/1999 Kay

* cited by examiner

*Primary Examiner*—David J Walczak
(74) *Attorney, Agent, or Firm*—Peter Giancana

(57) ABSTRACT

The present invention is a flow-thru cosmetic dispenser and applicator that comprises a means for controlling the flow of product from a reservoir to an applicator tip. The flow control means comprises wedge structures attached to biased hinges. The wedge structures move on the hinges in response to the removal or placement of a closure. The movement of the wedges alternately opens and pinches-off a deformable conduit in which the product flows. The invention includes means for converting any ordinary cosmetic container into a flow-thru container.

25 Claims, 6 Drawing Sheets

FLOW-THRU COSMETIC APPLICATOR PACKAGE

BACKGROUND

Flexible, flow-thru applicator packages for holding and dispensing cosmetic products are known. Such applicator packages generally comprise a deformable reservoir for holding a cosmetic product. Suitable cosmetic products may be in fluid, semi-viscous or powder form. A typical flow-thru applicator package further comprises an applicator tip, such as a bristled brush, a powder puff, a foam sponge, a molded plastic base covered with absorbent material or any other substrate for transferring onto a surface. The applicator package also comprises a means for conveying product from the reservoir to a specific location on or in the applicator tip. In use, product reaching the specific location of the applicator tip moves further to a position where the product may be transferred from the applicator tip to another surface. For example, the cosmetic product may emerge onto an exterior surface of the applicator tip from where it can be applied to the skin of a user.

In order to prevent product from reaching the surface of the applicator tip when the flow-thru applicator package is not in use, some means may be employed to reduce or prevent the unwanted flow of cosmetic product to the applicator tip. Unwanted flow of product may occur as a result of the reservoir being inadvertently squeezed, or as a result of gravity or vibration. Also, unwanted flow may occur as a result of an adverse pressure differential that can arise between the inside of the reservoir and the ambient atmosphere. This may occur as a result of temperature and/or pressure changes in the ambient atmosphere. For example, if the package is located in an unpressurized compartment of an airplane, the temperature and pressure inside the reservoir are likely to be greater than the ambient temperature and pressure outside the applicator package. This adverse differential tends to force the flowable product in the reservoir out of the package and will do so, if effective seals are not provided. Following are some examples of known flexible, flow-thru cosmetic applicator packages.

U.S. Pat. No. 2,994,897 discloses a conventional plastic squeeze bottle with threadably mounted closure. The container orifice is fitted with a relatively simple snap-fit or friction-fit insert that carries a tuft of bristles. A flow passage through the insert leads to the base of the bristles. No means of preventing unwanted flow is disclosed which means that leakage problems previously discussed may occur. Furthermore, the product flow passage ends at the very base of the bristles, still inside the container insert and does not extend into the bristle tuft. Because of this, the product must force its way between a section of tightly crimped bristles, whereby an even distribution of the product on the bristles is difficult to achieve. In contrast, the present invention does provide means to control unwanted flow and the flow passage extends out of the package housing proper and into the applicator tip for better product distribution.

In U.S. Pat. No. 4,040,753, the flow passage between a squeezable reservoir and a brush a head is normally sealed by the abutment of two surfaces that are snap fitted or friction fitted together. The act of squeezing the reservoir distorts one or more of the surfaces so that the seal is broken and the product under pressure can flow to the bristles. When pressure is removed, the distorted surface return to its original shape and the seal is restored. This device is fairly simple, but suffers from the fact that the flow passage leads to the outside of the bristle envelope at a level that is still inside the package housing proper, rather than leading some distance into the bristle envelope outside of the package housing. In order to be useful, product must be squeezed out of the reservoir onto the brush until some of the product is pushed up toward the distal end of the brush. This requires a significantly large dose of product, all of which may not be needed by the user. The portion of dispensed product that remains near the base of the bristles will not be used and may dry out between uses. Furthermore, with this device the flow passage is only open when the bottle is being squeezed. Therefore, if a user prefers to maintain the flow of product to the brush, she must maintain a tight, forceful grip on the reservoir while manipulating the brush for precise make up application. In contrast, the present invention injects product into the interior of the brush, substantially above the base of the bristles and outside the package housing proper, from where the product will flow evenly throughout the brush. Furthermore, once the closure is removed from the container, the flow passage is open even without squeezing the reservoir.

U.S. Pat. No. 3,545,874 is a squeeze container with brush applicator having a valve member housing disposed in the container neck. The valve member housing defines a flow passage from the reservoir to the bristles and comprises an axially movable valve stem which is normally sealingly biased against an orifice in the flow passage. The sealing bias is accomplished with a springs or with a bellows integrally molded as the walls of the valve member housing. The valve may be opened only by pressing the brush applicator sufficiently hard against a surface to overcome the sealing bias. Then, if the container is squeezed and/or upside down, product can flow from the reservoir to the bristles. Because the orifice in the flow passage is normally sealed, unwanted flow is controlled. However, this device is relatively complicated and requires several custom designed components each of which adds to the cost of the package. Furthermore, the flow passage does not extend into the bristle tuft beyond the package housing proper. As discussed above, this makes even distribution of the product on the bristles difficult to achieve. Other disadvantages of this design include the need for metal springs which are subject to corrosion, and a specially designed cap to engage the valve member housing. Both the spring and special cap drive up the cost of the package. Also, as noted, the brush applicator must be pressed sufficiently hard to open the valve. This precludes this device from being used for delicate applications, such as nail polish or eye makeup. In contrast, the present invention does not use springs, nor a complicated-to-manufacture bellows nor a custom designed closure. Furthermore, this device and some that follow are inferior to the present invention in that the prior art devices utilize components that slide relative to one another while having to maintain fluid tight seals. In order to achieve fluid tight seals of this type, tight tolerances must be maintained in manufacturing. The sliding fit of the components must be tight enough to form an effective seal but loose enough to permit one component to slid passed the other. Effective seals of this type are substantially more difficult to obtain than the sealing means used in the present invention, which does not utilize components that slide past one another in a sealing relationship.

More complicated approaches have been taken to develop squeeze containers having flow-thru brush applicators as, for example, disclosed in U.S. Pat. No. 4,748,990. Here an orifice in a flow passage between a reservoir and an applicator brush may be fully or partially closed off by a valve stem that moves toward or away from the orifice. The relative position of the fixed valve stem and the movable orifice may be continuously adjusted by the relative rotation of a threaded lower section on the container. In this way, the amount of product that can pass through the orifice may be controlled. Disadvantageously, this device is relatively complicated in that the valve stem (one essential part of the sealing mechanism) must be fixedly mounted in the container neck via a specially designed "central sealing plug", which is quite complicated and requires special care to ensure a good seal between it and the container neck orifice. Furthermore, the product flow passage orifice (the other essential part of the sealing mechanism) is itself part of a complicated specially designed housing and the product flow passage does not extend outside of the package housing.

U.S. Pat. No. 5,397,195 is another rotation-type system, this one analogous to a lipstick riser system. From the closed position, the relative rotation of a sleeve and container, axially advances the applicator holder. When this happens, an orifice at the base of the applicator holder moves away from a needle that seals the orifice when in the closed position. In this way, a flow passage from the reservoir to the brush is opened. When the relative rotation is performed in the opposite direction, the orifice moves toward and contacts the needle and is sealed off, so that product cannot flow. This and other flow-thru devices that use relative rotation to achieve translational motion and flow control are relatively complicated, costly to produce and less reliable than the present invention. Also, here again, the product flow passage does not extend outside of the package housing.

The disclosures of U.S. Pat. No. 3,655,290, 4,368,746 and 5,904,433 are alike in that they describe flow-thru applicators that have a flow control means that is activated by a container closure. In U.S. Pat. No. 3,655,290 a brush applicator is mounted in a "nozzle" that is capable of axial movement. When a closure that is specially designed for contact with the nozzle is applied to the container, then the nozzle is pushed further into the container and a portion of a flow passage from the reservoir to the brush becomes blocked. When the closure is removed from the container, the nozzle may be extended slightly, enough to open the flow passage. The nozzle may be extended by a pressure at the back of the nozzle that is created when a user squeezes the container or by a spring optionally provided to push on the back of the nozzle. This device is inferior to the present invention in that this prior art device utilizes components that slide relative to one another while having to maintain fluid tight seals. The disadvantages of this were discussed above. Also, the flow passage of this prior art device terminates at the base of the bristles, still inside the housing and does not extend into the center of the bristle tuft beyond the housing. As discussed above, this makes even distribution of the product on the bristles difficult to achieve. The use of a spring also makes this design inferior to the present invention.

U.S. Pat. No. 4,368,746 discloses a lip-cream applicator comprising a squeezable tube of cream having a product exit orifice. The exit orifice emerges into a flow passage of an applicator tip construction, that leads to the base of an applicator pad. The applicator tip construction is axially movable relative to the exit orifice of the tube. Unopposed, a spring holds the applicator tip construction in its fully extended position and the exit orifice is open. However, when a screw cap is applied over the applicator tip construction and allowed to engage threads of the tube, the applicator tip construction is forced closer to the exit orifice, against the action of the spring, until a valve head within the tip construction seats in the exit orifice to cut off the flow of product from the tube. This device is inferior to the present invention in that this prior art device utilizes components that slide relative to one another while having to maintain fluid tight seals. The disadvantages of this were discussed above. Other disadvantages of this design include the need for a metal spring, which is subject to corrosion, and a specially designed cap to engage the applicator tip construction. Both the spring and special cap drive up the cost of the package. A specially designed cap is needed because, over the life of the package, the cap is repeatedly forced against the applicator tip. If precautions are not taken, this abrasive contact may damage the applicator tip. Also, as noted, the applicator tip construction is axially movable and this movement may occur when the applicator tip is pressed against the skin during use. This may be a distraction to a user trying to accurately apply the product. Also, if the user presses hard enough, the flow of product is reduced or cut off during use.

U.S. Pat. No. 5,904,433 describes a squeezable flow-thru applicator system having a flow passage that opens when a container closure is removed from a container and that closes when the closure is applied to the container. As the closure is being applied to the container, the closure bears down on radially projecting tabs which causes the applicator housing to deform at specially molded thin-walled portions. This deformation displaces sealing strips located near the thin walled portions, moving the sealing strips toward opposing surfaces until the sealing strips and opposing surfaces form a seal, closing off the flow passage. Removing the closure, releases the deformation and the flow passage opens. This device is quite complicated and relatively difficult to manufacture because it requires custom components having centimeter-sized portions where the wall thickness must be tightly controlled to impart specific flexural properties to the wall. Deforming one component (i.e. thin walled portion) in order to precisely move an adjacent component (i.e. sealing strip) into a sealing relationship with a third component (opposing surfaces) is a significantly complex design, especially in the cosmetics market where pressure to keep component costs low is acute. Furthermore, the product flow passage terminates at the base of the bristles, still within the housing rather than terminating within the applicator tip. In contrast, the present invention uses a deforming sealing means that is responsive to a closure, while having a significantly simpler design than this prior art device.

U.S. Pat. No. 1,067,596 describes a piston-activated shaving cream brush that has a rubber product flow passage that extends substantially beyond the package housing proper into the interior of the applicator tip. To reduce the uncomfortable feel of drawing a rigid member over the skin, the flow passage is flexible rubber However, the uncomfortable feel is not completely eliminated and the flow passage interferes with the operation of the brush. This is unlike the present invention where the flow passage does extend beyond the package housing proper into the applicator tip for maximum product distribution, but does not interfere with the function of the applicator tip nor cause an uncomfortable experience. The present invention does not utilize a relatively complex piston system.

OBJECTS OF THE INVENTION

A main object of the present invention is to provide a flow-thru cosmetic applicator package having a simple construction compared to the prior art.

Another object is to provide a flow-thru cosmetic applicator package having high reliability compared to the prior art.

Another object is to provide a means for transforming any existing container having a standard neck finish into a flow-thru applicator package.

SUMMARY OF THE INVENTION

The present invention is a flow-thru applicator package for flowable products comprising a reservoir capable of dispensing a flowable product; an applicator tip having a base and an external surface; a deformable, resilient conduit capable of conducting product between the reservoir and the base of the applicator tip; a means of deforming the deformable conduit; and a closure. Additionally, the present invention may comprise a rigid conduit in flow communication with the deformable conduit. Additionally, the present invention may comprises a ferrule near the base of the applicator tip. Additionally, the closure may comprise an inner cap and an overshell. The reservoir may be located inside a flexible container, such as a tube, or inside a rigid container, such as a glass bottle. The reservoir and container may assume any shape. The present invention also encompasses a simple means for making any cosmetic dispensing container having a standard neck finish into a flow-thru applicator system.

DETAILED DESCRIPTION OF THE INVENTION

Figure 1:
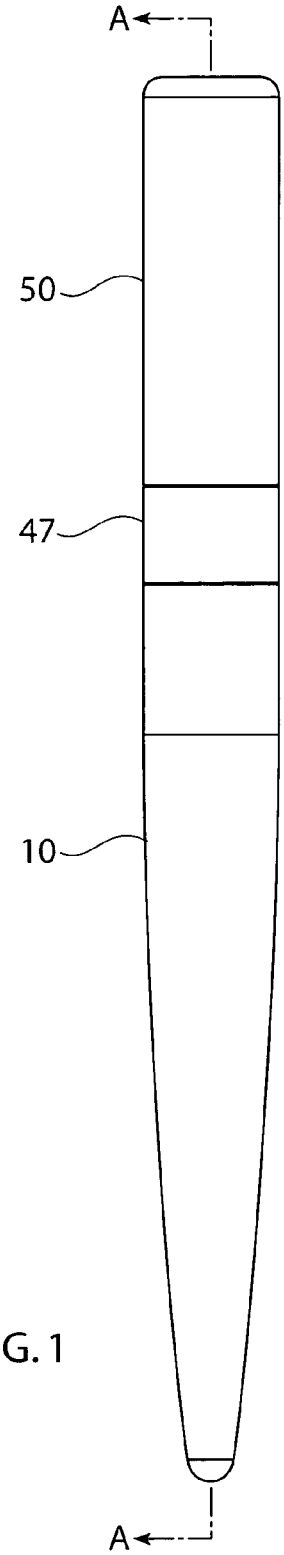
FIG. 1 is an elevation view of one embodiment of the present invention.

Throughout this specification, the terms "comprise," "comprises," "comprising" and the like shall consistently mean that a collection of objects is not limited to those objects specifically recited.

Throughout the specification, the term "conduit" shall consistently refer to the solid material that forms the boundary of a lumen, not to overlap with the lumen itself.

Referring to FIGS. 1-4, the present invention comprises a container (10) that defines a reservoir (11) that is capable of holding a flowable product (1). The container comprises one or more walls (12) and an orifice (13) for dispensing the flowable product. The one or more walls may be flexible or rigid. For example, the container may be a plastic squeezable tube, a hard plastic jar or a glass bottle. The container may be any of standardized types commonly encountered in consumer goods industries or the container may be custom designed and completely non-standard. The container and reservoir therein may be any shape, however, as the container may serve as a handle for the applicator package, it is preferred that the container exterior be suitable for grasping in the hand of a user. For example, the container exterior may define an elongated, generally cylindrical shape, like that of a pencil. Optionally, the exterior of the container may incorporate any features that enhance the grip of a user or that assist in the manipulation of the article. Optionally, the container will further comprise a neck finish (15) of standard construction and dimensions. Such structure and dimensions are well known in the container art. The voluntary standards promulgated by the Rigid Plastic Packaging Institute, the Glass Packaging Institute and the European Tube Manufacturers Association are some examples. Preferably, the flow-thru cosmetic applicator package of the present invention comprises a container that has a standard neck finish.

The applicator package of the present invention comprises a deformable, resilient conduit (20) capable of conducting product between the reservoir (11) and the base of the applicator tip (see below). One embodiment of the deformable conduit is shown in FIGS. 4-7. The deformable conduit defines a lumen (21) in which product from the reservoir may flow. The deformable conduit has proximal and a distal ends (22, 23) that define proximal and distal orifices (24, 25) of the lumen. The proximal orifice (24) is in flow communication with the container orifice (13). Preferably, substantially all of the product that emerges from the container orifice must pass into the proximal orifice of the lumen, such that none of the product is allowed to bypass the proximal orifice. To achieve this, an effective fluid tight seal may be implemented at the point of contact between the container and the deformable conduit. If there are any intervening elements between the container and the deformable conduit, then the entire flow path from the container to the deformable conduit should be sealed to prevent leakage of the flowable product. In the embodiment of FIG. 6, the deformable conduit comprises a sealing flange (26) that is designed to lie flat on top of the neck finish (15) of the container. The sealing flange is pressed firmly against the top of the neck finish by means to be discussed below, such that an effective seal is formed. The distal orifice (25) of the lumen is in flow communication with applicator tip (30) so that product from the reservoir may pass, directly or indirectly, into the applicator tip.

At least a portion of the deformable, resilient conduit (20) comprises one or more materials that change shape when pressure is applied and that substantially returns to an original shape when the pressure is removed. In use, only a defined portion (27) of the conduit will be subjected to deforming pressure. Nevertheless, the entire conduit (20) may be made out of deformable, resilient materials. This may be done if it is easier to manufacture the deformable conduit as a unitary body of a single material. When the applicator package is closed and not in use, the defined portion (27) is pinched, such that the flow of product through the deformable conduit is restricted or cut off altogether. Suitable materials for the defined portion include those resiliently elastic materials with low swell, consistent mechanical response and a tear strength that is sufficiently high to resist tear against the forces that are applied to it in use. Generally, suitable materials include natural and synthetic rubbers. Among the synthetic rubbers, silicone and non-silicone elastomers may be used. A non-exhaustive list of suitable non-silicone elastomers include: styrene-butadiene elastomers (BUNA-S and SBR); polybutadiene; polyisoprene; nitrile elastomers (BUNA-N); butyl; neoprene; ethylene propylene rubbers and urethane elastomers. Generally, the broad family of silicone elastomers are suitable for the resilient conduit and defined portion and will be preferred when the resilient conduit may be subjected to heat during a secondary manufacturing operation. For example, silicone elastomer may be preferred when the resilient conduit is first assembled to an applicator tip and then heat is applied to the applicator tip to cure an adhesive used in the formation of the applicator tip. Such is considered a realistic manufacturing scenario.

Figure 8:
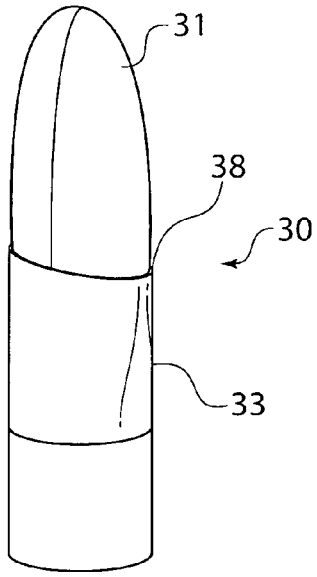
FIG. 8 is an elevation view of an applicator tip with ferrule.
Figure 9:
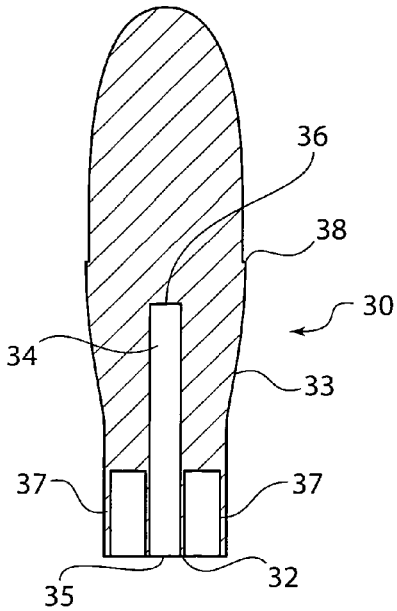
FIG. 9 is an axial cross section of FIG. 8.
Figure 10:
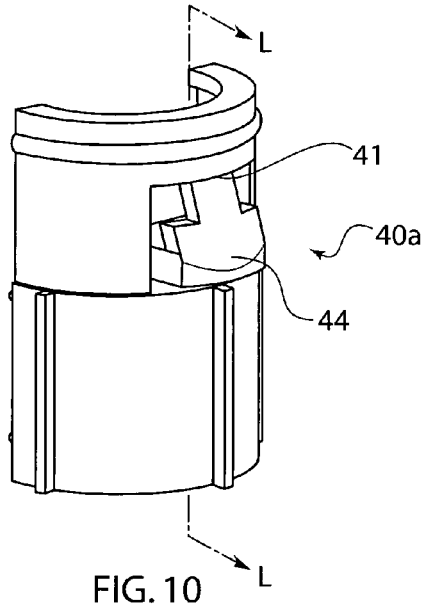
FIG. 10 is an elevation view of a flow control means sub-housing.
Figure 11:
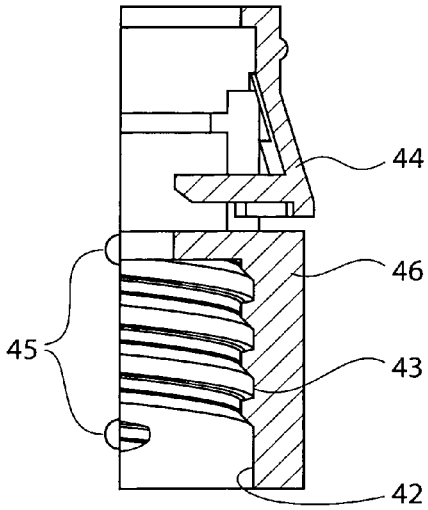
FIG. 11 is a cross section through line L-L of FIG. 10.

The applicator package of the present invention comprises an applicator tip (30; see FIGS. 8, 9). The applicator tip comprises an external surface (31). By "external surface" we mean any portion of the applicator tip from which flowable product (1) may be transferred by contact with a receiving surface. Per this definition, the exact shape and dimensions of the external surface vary from application to application because on a first application one portion of the tip may effect product transfer and on a second application some other portion of the tip may effect product transfer. By "receiving surface" we mean any substrate that is capable of receiving product directly from the external surface. For a cosmetic applicator, the receiving surface is most often some portion of the user's body, i.e. skin, hair, nails, etc. The external surface of the applicator tip may be formed by any type of known applicator surface. For example, the external surface may be formed by the bristles of a brush or comb, or a sponge, a powder puff, a flocked substrate or a molded substrate with a covering of absorbent material, for example, an applicator tip sometimes referred to as a "doe-foot". Alternatively, the external surface may be any other surface that is suitable for transferring a flowable product to a receiving surface.

Generally, the applicator tip (30) has a base (32) that is fashioned to be held securely in flow communication with the distal orifice (25) of the lumen (21). The base of the applicator tip may be held in this configuration by any suitable means. For example, the base of the applicator tip may be glued, in-molded, welded, crimped, snap-fitted or screw-fitted, directly or indirectly to the distal end (23) of the deformable conduit. In the embodiment of FIG. 8, a ferrule (33) intervenes between the applicator tip and the distal end of the deformable conduit. The ferrule is used in a fashion generally known in the art. Here, the ferrule has the dual purpose of crimping together the bristles so as to form a brush and also securing the applicator tip in flow communication with the distal orifice of the lumen. For example, a proximal end of the ferrule may be partially inserted into the distal orifice of the lumen. The distal orifice and ferrule may be sized to provide a liquid tight friction fit between the two. Optionally, (see FIG. 5) a stronger friction fit may be achieved by providing, near the base of the applicator tip, one or more thin-walled portions (37) suitable for friction fit insertion into grooves (29) cut into the top of the deformable conduit. Also, annular interference rings may be provided on the outside of the ferrule and/or inside of the distal orifice to increase the grip of the distal orifice on the ferrule.

Figure 5:
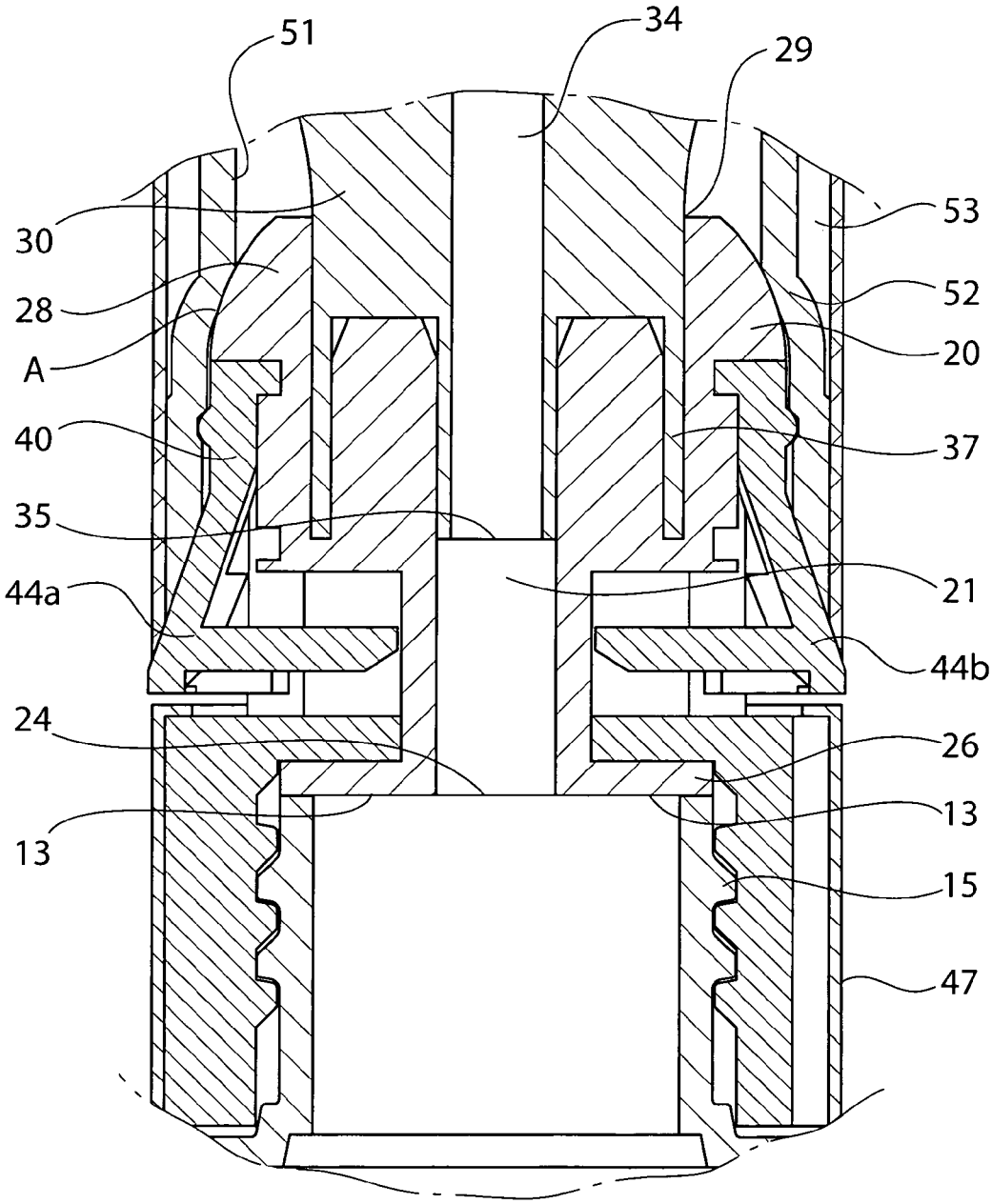
FIG. 5 is a detail view of section H of FIG. 4.
Figure 6:
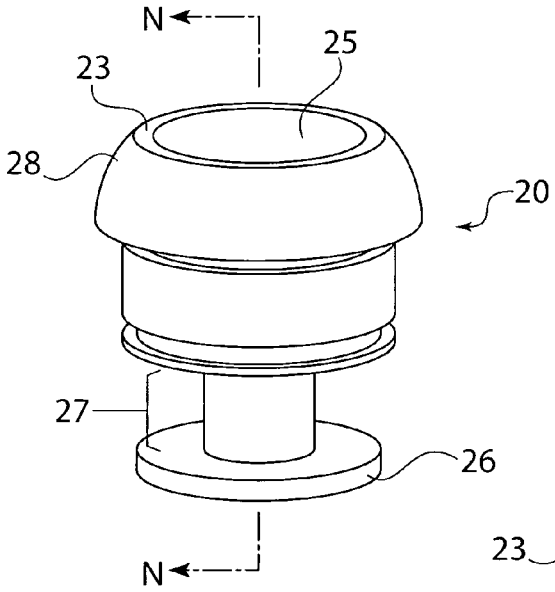
FIG. 6 is an elevation view of a deformable conduit.
Figure 7:
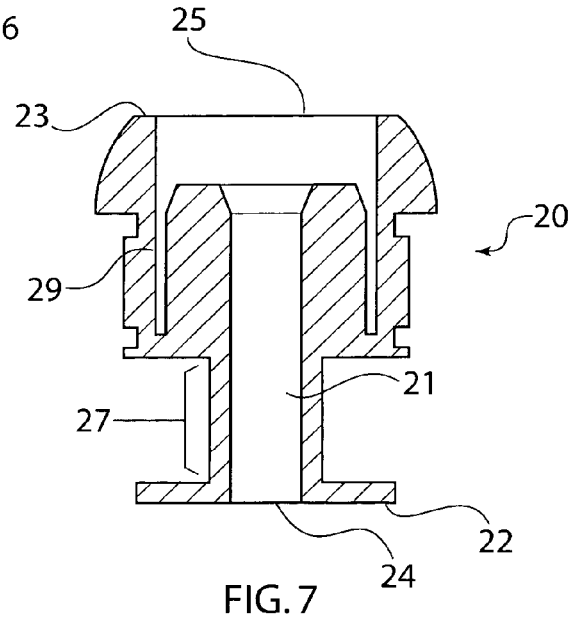
FIG. 7 is a cross section through line N-N of FIG. 6.

Optionally, a flow tube (34) may be provided inside applicator tip (see FIGS. 5, 9). A proximal end (35) of the flow tube is in flow communication with the lumen (21). From there, the flow tube extends within that portion of the applicator tip (30) that is inside the ferrule (33). The flow tube terminates below the top (38) of the ferrule in a central region of the applicator tip, whence an exit opening (36) is located near its distal end. With this design, the product flow passage advantageously terminates beyond the package housing proper, inside the applicator tip, at a level beyond the tightly crimped portion of the applicator tip, in such a way that the flow tube does not interfere with the function of the applicator tip and no uncomfortable experience is caused, while allowing product to be dispersed throughout the applicator tip more evenly than would be the case if product emerged from a flow passage near the base of the applicator tip. For this reason, an applicator according to the present invention preferably has a flow tube as described.

The flow tube may be constructed of any suitable material such as plastic, natural and synthetic rubber, silicone elastomer or metal. Generally, the flow tube may be flexible or rigid, but a substantially rigid flow tube may hold up better to wear and tear. Preferably, the flow tube is resistant to corrosion and is non-reactive with the product being dispensed. Stainless steel is one example of a material meeting these requirements. The flow tube, particularly if constructed at least in part of a flexibly resilient material, may optionally be self closing at its distal end, inside the applicator tip. By self-closing it is meant that when product is not passing through distal end of the flow tube, the distal end closes automatically. With a self closing distal end, product remaining in the flow tube is less susceptible to dry-out and contamination from the ambient atmosphere. A self closing flow tube may be realized if the exit opening (36) is a slit in the distal end of the flow tube. Such a slit opens in response to product pressing against it and closes when the pressure is released. Given the field of endeavor, it is anticipated that the inner diameter of the flow tube may be anywhere between about 0.25 mm and 10 mm, as the situation dictates.

Thus far, product may flow from the reservoir through the deformable conduit and onto the external surface of the applicator tip. Now, a means for controlling the flow of product through the deformable conduit will be described.

Figure 2:
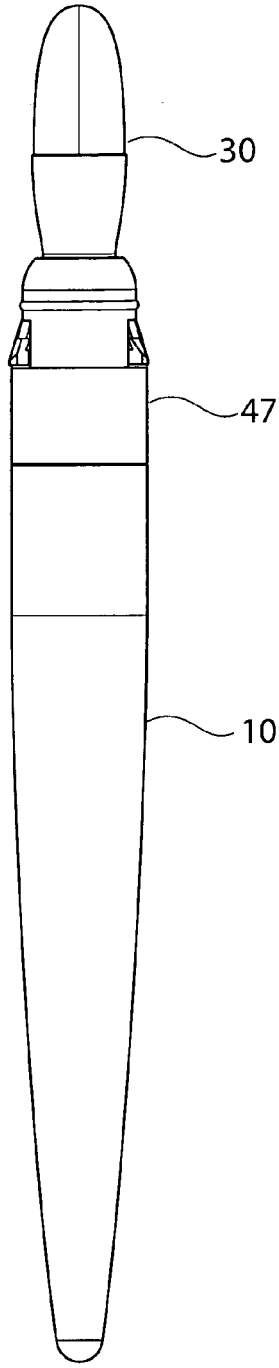
FIG. 2 is the elevation view of FIG. 1, with the closure removed.
Figure 3:
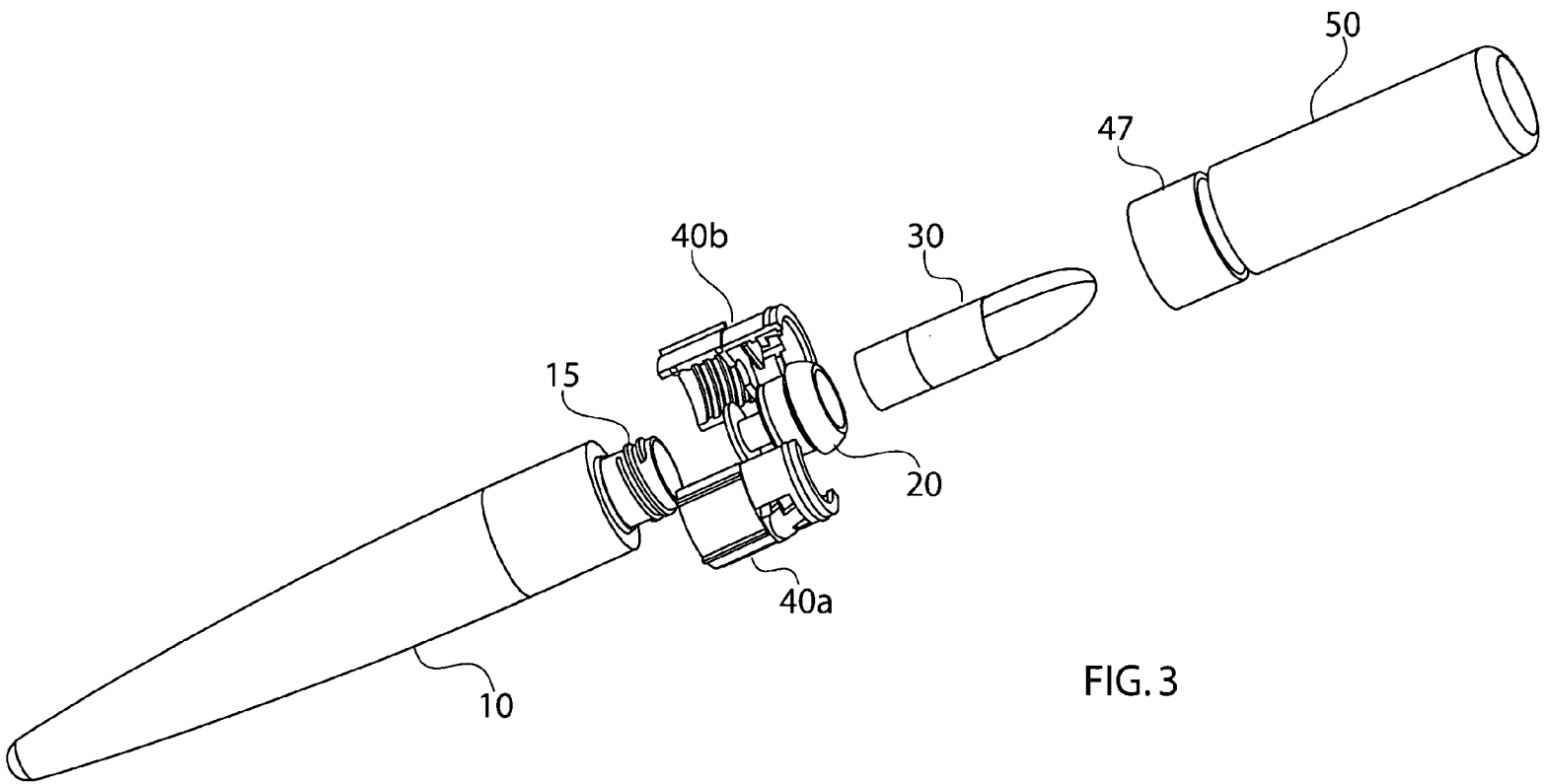
FIG. 3 is an exploded view of the invention of FIG. 1.

Generally, any means of reversibly deforming the deformable conduit, such that the lumen (21) is temporarily narrowed under the action of an applied pressure, may be suitable as a flow control means. By "reversibly" it is meant that the lumen returns substantially to its pre-deformed dimensions after the applied pressure is removed. One embodiment of a means for controlling the flow of product through the deformable conduit is shown in FIGS. 3, 5, 10 and 11. As shown there, a flow control means may comprise a generally hollow, cylindrical housing (40). In a preferred embodiment, the housing is formed of two semi-cylindrical sub-housings (40*a*, 40*b*), each having one or more biased hinges (41). The two semi-cylindrical housings are capable of being positioned together such that their combination forms the cylindrical housing. The semi-cylindrical housings may be provided with means to hold them together to form a cylindrical housing. Such means may include cooperating snap-fit or friction-fit structures, like detents (45) and tight-fitting recesses to receive the detents. By forming the cylindrical housing in pieces, it is easier to position the deformable conduit (20) inside the cylindrical housing as shown, for example, in FIGS. 3 and 4. In principle, there may be nothing that prevents the cylindrical housing from being formed of more than two sub-housings or as a unitary body. The housing may be formed from any material that is suitable for molding into the required shape. Plastics or elastomers are preferred. For example, the housing may be molded from acetal or copolymer acetal (or other materials with sufficient dimensional stability, weldability and low memory resilience), in two sub-housings and subsequently ultrasonically welded after the deformable conduit has been located inside the two pieces. Alternatively, a cylindrical band (47) may be provided to ensure that the two or more sub-housings do not separate from one another. In FIGS. 2 and 3, for example, after the deformable conduit has been positioned between the two sub-housings, the sub-housings may be snap-fit together. Not wanting to rely entirely on this snap-fit, a cylindrical band may be slipped over the outside of the housing, to a position where it does not interfere with the biased hinges (41).

A biased hinge (for example, a living hinge or spring-loaded hinge) is one that returns to a resting position when an applied force is removed. The one or more biased hinges (41) are positioned in the housing wall such that one or more wedges (44) may be rotated toward and away from the defined portion (27) of the deformable conduit. In this regard, a wedge occupies a first position when the wedge is not in deforming contact with the defined portion. A wedge occupies a second position when the wedge contacts the defined portion such that the wedge causes a deformation of the defined portion and substantially stops the flow of liquid or powder product through the lumen (21). A third position of the wedge is defined as any position intermediate between first and second position. In third position, the one or more wedges reduce the flow of product through the deformable conduit by reducing the size of the lumen. However, the flow of product is not substantially cut off altogether as it is when the one or more wedges is in second position. The advantage of this design, is that it creates the possibility of continuously adjusting the volume of product that flows through the deformable conduit.

An alternative embodiment may forgo the separate housing (40) and the biased hinges and wedges could be integrated into the structure of the deformable conduit. In principle, the present invention only requires that the wedges be capable of occupying a first position such that the wedges are not in deforming contact with the defined portion and a second position such that the wedges deform the defined portion to substantially stop the flow of product through the lumen.

The number of wedges (44) required to substantially stop the flow of any product through the deformable conduit (20) depends on the exact geometry and dimensions of the deformable conduit and wedges. However, the required number of wedges may be readily determined by one skilled in the art and by routine experimentation. The preferred embodiment shown in FIG. 3 has wedges that oppose each other such that the deformable conduit may be pinched between two wedges. Generally, two wedges may be sufficient for most cosmetic applicators. In principle, however, the desired flow control may also be obtained with one wedge or some number greater than two. Furthermore, while the two wedges in FIG. 3 are located at the same axial position along the conduit, multiple wedges may generally be located at different positions along the longitudinal axis of the conduit. The placement of the wedges is entirely a matter of convenience, the only requirement being that the wedges are able to rotate toward the deformable conduit under the action of an applied pressure and rotate away from the deformable conduit when the pressure is removed. It should be noted that when the wedges are in second position, so that the flow of liquid or powder product is substantially cut off, it may still be possible for product vapors to move through the deformable conduit. This may, in fact, be desirable, when for example the vapors prevent the applicator tip from drying out.

The wedge design just described does place some practical limitation on what the diameter of the lumen (21) should be. For example, in order to substantially cut off the flow of product through the lumen, two opposing wedges must each travel a distance equal to half the diameter of the deformable conduit minus the wall thickness. This means that the wedges themselves must be at least that wide and protrude that same distance on each side of the deformable conduit. As will be discussed below, the wedges are rotated from first to second position by forcing a closure over the wedges. Practically speaking, there is a limit to how far out the wedges can protrude before it becomes to difficult to apply the closure. To provide some guidance, the diameter of the lumen (inner diameter of the deformable conduit) may be up to about 8 mm.

The housing (40) surrounds and supports at least a portion of the deformable conduit (20). Furthermore, when the housing is secured to the neck finish (15), then the flange (26) of the deformable conduit is pressed securely against the top of the neck finish, such that the flange maintains sealing contact with the top of the neck finish. The housing may be secured to the neck finish by any suitable means. When the neck finish comprises spiral threads, then the preferred method is the use of cooperating threads (43) on a housing inner wall (42). The axial force supplied by the cooperation of the housing and the neck finish is sufficient to create a tight seal between the flange of the deformable conduit and the top of the neck finish. For example, in the embodiment of FIG. 11, the inner wall of the housing is provided with an annular shoulder (46) that rests on top of the flange of the deformable conduit. As the housing is secured to the neck finish (15), the shoulder bears down on the flange, forcing the flange against the top of the neck finish and forming an airtight and liquid tight seal.

Figure 4:
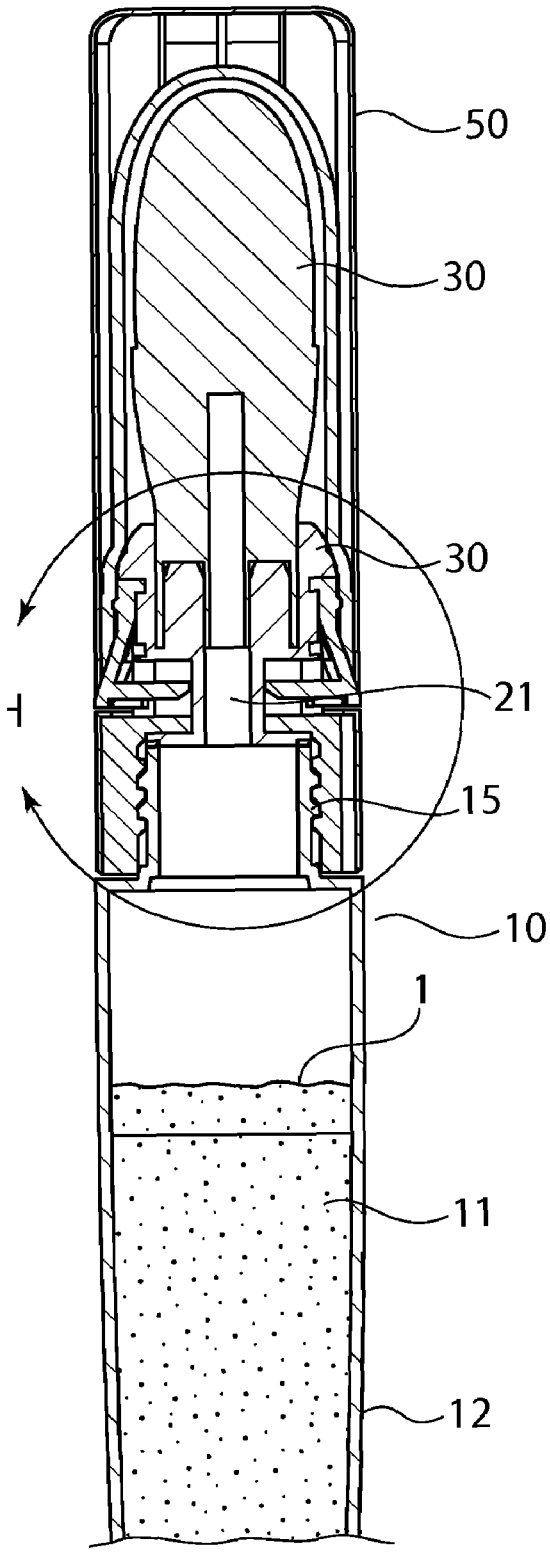
FIG. 4 is a cross section through line A-A of FIG. 1.

The flow-thru applicator package of the present invention further comprises a closure (50) capable of covering the applicator tip and being secured on the cylindrical housing (40). The closure serves two main purposes. First, the closure protects the applicator tip when the applicator is not in use. Second, the closure actuates the flow control means to prevent the flow of product through the deformable conduit. In the embodiment of FIG. 4, the closure is shown at the point of contacting the one or more wedges (44). Any further advance of the closure onto the housing will force the wedges to rotate from first position to second position, thereby narrowing the lumen (21) and substantially preventing the flow of product through the lumen. Thus, when the applicator is not in use, product is prevented from migrating from the reservoir (11) to the applicator tip (30). The internal dimensions of the closure may be readily determined by one skilled in the art, the only requirement being that the closure forces the one or more wedges into second position when the closure is fully seated. Various options for doing this exist.

For example, an inner wall (51) of the closure (50) may be dimensioned to directly contact the one or more wedges (44) and move them from first position to second position or from first position to third position. In the latter case, additional means must be provided to move the wedges from third position to second position. For example, the inner wall of the closure may have one or more beads or detents that are positioned to rest on top of the one or more wedges when the closure has reached its fully seated position. The detents bias the wedges from third position to second position.

Alternatively, the inner wall (51) of the closure (50) may have no direct contact with the one or more wedges (44). In this case, detents are provided on the inner wall such that the detents contact the wedges as the closure reaches its fully seated position on the package, and the detents force the wedges from first to second position.

Optionally, the inner wall (51) of the closure (50) may be dimensioned to contact the wedges (44) over a substantial portion of the height of the inner wall, or it may be dimensioned to contact the wedges only when closure comes to its fully seated position.

The closure (50) may be seated on the housing by any suitable means, such as friction fit, snap fit, thread engagement, interference beads, etc. In the embodiment of FIG. 4, the closure is friction fit onto the sub-housings (40*a*, 40*b*). Also visible in FIG. 5, as an optional feature, a portion of the inner wall (51) of the closure makes friction fit contact with an upper portion (28) of the deformable conduit (20). Advantageously, this contact may form an airtight seal (designated "A" in FIG. 5), thus protecting the applicator tip from dry-out or other affects of the ambient atmosphere.

The closure (50) may optionally comprise an inner cap (52) and an overshell (53), as is commonly known in the art. When the closure comprises an inner cap, then all references above to an inner wall (51) of the closure are to be understood as being the inner wall of the inner cap. The closure may be fashioned from any suitable material, for example, the inner cap may be polypropylene and the overshell may be aluminum. It will be appreciated then, that the closure of the present invention, while being critical to the operation of the package, need not be a specially designed nor a custom closure as some of the prior art requires. For example, a conventional friction fit closure may be sufficient.

Thus described, the present invention is simple to operate. Starting from a closed position, the flow-thru package is closed by a closure (50), the wedges (44) are located in second position and the deformable conduit (20) is pinched off, so that substantially no liquid or powder product may flow through the deformable conduit. Even so, volatile vapors in the reservoir may be able to pass through the deformable conduit to keep the applicator tip from drying out. When a user removes the closure, the wedges rotate from second position to first position under the action of the biased hinges (41). As the wedges move to first position, the resiliency of the deformable conduit forces the conduit to return to its undeformed state and the lumen (21) is opened to product flow. By whatever suitable means, product is urged from the reservoir (11). If the container (10) is soft and pliable, squeezing may be used to force product from the reservoir. If the container is not squeezable, then shaking or tapping the container may be suitable to move product from the reservoir. Product from the reservoir passes into and through the deformable conduit, into and through the flow tube to emerge in an interior region of the applicator tip. While additional product is being urged from the reservoir, the product already in the interior region of the applicator tip spreads out radially to emerge on the surface of the applicator tip uniformly distributed. The user applies the product from the applicator tip to a substrate. If more product is needed, the user urges more product from the reservoir and repeats the application. When finished, the user replaces the closure onto the package, forcing the wedges against the defined portion (27) of the deformable conduit, pinching off the deformable conduit and closing the lumen to product flow.

As may be appreciated, the design of the present invention is comparatively simple. The present invention does not use any check valves or stoppers whose reliability depends on precise mating tolerances and whose function may be compromised by contact with the product. The present invention does not use components that form sliding seals. The present invention does not require a specially designed, unconventional closure. The present invention does not require a separate passageway for vapor discharge nor a pressure-activated check valve to control a vapor passageway. Expensive and potentially corrosive metal springs are not required. No mechanism for advancing and retracting the brush is needed. The flow control means of the present invention is unlike the prior art, in that the prior art relies on forming seals by bringing together sealing surfaces that must be manufactured to precise tolerances for an effective seal to be achieved. In contrast, in the present invention the pinching off of the deformable conduit requires less precision and is therefore simpler to execute consistently. Although the conduit is deformable, it does not require thin walled portions as does the prior art. The generally cylindrical deformable conduit is much simpler to manufacture than the componentry of U.S. Pat. No. 5,904,433.

The present invention also encompasses a simple method for converting any cosmetic dispensing container into a flow-thru applicator package. The dispensing container may or may not have a standard neck finish. Generally, the method comprises the steps of providing a container that is to be converted into a flow-thru applicator package, fitting the container finish with a housing that houses a deformable conduit, the deformable conduit being connected to an applicator tip that has a base that is held securely in flow communication with the deformable conduit; further providing a means of deforming the deformable conduit, and providing a closure that activates the conduit-deforming means when the closure is seated on the package. The method may be refined by providing any of the additional or optional structure or arrangements described above.

What is claimed is:

1. A flow-thru cosmetic dispenser for a flowable product comprising:

a container having a reservoir that is capable of dispensing a flowable product through a container orifice;

an applicator tip having a base and an external surface, wherein the applicator tip may comprise a bristled brush, a comb, a sponge, a powder puff, a flocked substrate or a doe-foot;

a deformable, resilient conduit that defines a lumen which, in an undeformed state, is capable of conducting product between the reservoir and the applicator tip, but which in a deformed state is hindered from conducting product;

the deformable conduit having proximal and a distal ends which define proximal and distal orifices of the lumen; and a closure having:

an opened position, wherein the closure is not covering the applicator tip and the resilient conduit is in the undeformed state; and a closed position, wherein the closure is covering the applicator tip and the resilient conduit is pressured into the deformed state by the closure.

2. The flow-thru cosmetic dispenser according to claim 1 wherein a portion of the deformable conduit contacts the container, forming a fluid tight seal, therebetween.

3. The flow-thru cosmetic dispenser according to claim 2 wherein the container further comprises a neck finish and the deformable conduit comprises flange that lies flat on top of the neck finish to form the fluid tight seal.

4. The flow-thru cosmetic dispenser according to claim 1 wherein at least a defined portion of the deformable conduit comprises one or more deformable, resilient materials that assume a deformed state when the closure is moved into the closed position and that substantially return to an undeformed state when the closure is moved into the opened position.

5. The flow-thru cosmetic dispenser according to claim 4 wherein the defined portion is made of natural or synthetic rubber.

6. The flow-thru cosmetic dispenser according to claim 5 wherein the synthetic rubber is a silicone elastomer.

7. The flow-thru cosmetic dispenser according to claim 6 wherein the synthetic rubber is a non-silicone elastomer chosen from the group consisting of styrene-butadiene, polybutadiene, polyisoprene, nitrile elastomers, butyl, neoprene, ethylene-propylene rubbers and urethane elastomers.

8. The flow-thru cosmetic dispenser according to claim 4 wherein the defined portion is capable of assuming a deformed state that hinders the flow of product into the applicator tip.

9. The flow-thru cosmetic dispenser according to claim 8 wherein the defined portion is capable of assuming a deformed state that cuts off the flow of product altogether.

10. The flow-thru cosmetic dispenser according to claim 4 further comprising one or more wedges capable of occupying a first position such that the wedges are not in deform deforming contact with the defined portion, and a second position such that the wedges deform the defined portion to substantially stop the flow of product through the lumen.

11. The flow-thru cosmetic dispenser according to claim 10 further comprising one or more biased hinges, one associated with each wedge.

12. The flow-thru cosmetic dispenser according to claim 11 comprising two biased hinges and two associated wedges.

13. The flow-thru cosmetic dispenser according to claim 11 wherein the one or more hinges are located in a wall of a housing that surrounds at least a portion of the deformable conduit.

14. The flow-thru cosmetic dispenser according to claim 13 wherein the housing is comprised of more than one sub-housings that fit together.

15. The flow-thru cosmetic dispenser according to claim 14 wherein the sub-housings are fit together by friction fit, snap fit, welding or mechanical band.

16. The flow-thru cosmetic dispenser according to claim 13 wherein the container further comprises a neck finish, the deformable conduit further comprises a flange and the housing is secured to the neck finish such that the flange forms an effective seal against the neck finish.

17. The flow-thru cosmetic dispenser according to claim 16 wherein the housing is secured to the neck finish by means of cooperating screw threads.

18. The flow-thru cosmetic dispenser according to claim 13 wherein the closure is capable of being secured to the housing.

19. The flow-thru cosmetic dispenser according to claim 18 wherein the one or more wedges occupy the first position when the closure is not on the housing and occupy the second position when the closure is fully seated on the housing.

20. The flow-thru cosmetic dispenser according to claim 1 wherein the applicator tip comprises a brush.

21. The flow-thru cosmetic dispenser according to claim 1 wherein the base of the applicator tip is held securely in flow communication with the distal orifice of the lumen.

22. The flow-thru cosmetic dispenser according to claim 21 wherein the base of the applicator tip is glued, in-molded, welded, crimped, snap-fitted or screw-fitted, directly or indirectly to the distal end of the deformable conduit.

23. The flow-thru cosmetic dispenser according to claim 22 wherein the base of the applicator tip is secured in flow communication with the distal orifice of the lumen by means of a ferrule, one end of which is crimped to the base of the applicator tip and the other end is inserted into the distal orifice of the lumen.

24. The flow-thru cosmetic dispenser according to claim 1 further comprising a flow tube, a proximal end of which is in flow communication with the lumen and a distal end of which is located in an interior region of the applicator tip.

25. The flow-thru cosmetic dispenser according to claim 24 wherein the distal end of the flow tube is self-closing.

* * * * *